US006277028B1

(12) United States Patent
Liu

(10) Patent No.: US 6,277,028 B1
(45) Date of Patent: Aug. 21, 2001

(54) DETACHABLE SWING

(75) Inventor: Kun-Hei Liu, Taipei (TW)

(73) Assignee: Green Wheel Industrial Co., Ltd., Taipei (TW)

( * ) Notice: Subject to any disclaimer, the term of this patent is extended or adjusted under 35 U.S.C. 154(b) by 0 days.

(21) Appl. No.: 09/571,361

(22) Filed: May 15, 2000

(51) Int. Cl.[7] ..... A63G 9/12

(52) U.S. Cl. ..... 472/118; 472/119; 472/125; 248/163.2

(58) Field of Search ..... 472/118, 119, 472/120, 121, 122, 123, 124, 125; 297/273, 274, 276, 281; 248/163.2, 165, 166

(56) References Cited

U.S. PATENT DOCUMENTS 4,256,300 * 3/1981 Boucher ..... 472/118
4,537,392 * 8/1985 Defibaugh ..... 472/125
5,388,797 * 2/1995 Trevino et al. ..... 248/370
6,001,021 * 12/1999 Battaglia ..... 472/118

* cited by examiner

*Primary Examiner*—Kien T. Nguyen
(74) *Attorney, Agent, or Firm*—Varndell & Varndell, PLLC

(57) ABSTRACT

A detachable swing is constructed to include two end assemblies, a top rail coupled between the end assemblies at one of selective elevations, a swing hanger mounted on the top rail to hold a folding collapsible swing seat, two pairs of foot couplings, two bottom supports detachably coupled between the foot couplings and arranged in parallel, two pairs of legs bilaterally obliquely coupled between the end assemblies and the foot couplings, and two chinning bars detachably connected between the legs at two opposite lateral sides, and two barrels mounted on the top rails between the swing hanger and the end assemblies to stop the swing hanger from sliding on the top rail.

1 Claim, 4 Drawing Sheets

DETACHABLE SWING

BACKGROUND AND SUMMARY OF THE INVENTION

The present invention relates to backyard equipment, and more specifically to a detachable swing that can be adjusted to one of a series of elevational FIG. 1 shows a swing according to the prior art. This structure of swing 8 comprises a transmission mechanism 81 disposed at the topside thereof. A rotary handle controls the transmission mechanism 81 to swing a swing seat. This structure of swing is complicated and expensive. Further, because the frame structure of this structure of swing is not collapsible, the bulky dimenstion of the swing occupies much delivery space.

The present invention provides a detachable swing, which eliminates the aforesaid drawbacks. It is one object of the present invention to proivde a swing, which is detachable. It is another object of the present invention to provide a detachable swing, which is safe and stable in use. It is still another object of the present invention to provide a detachable swing, which can be adjusted to one of a series of elevational positions. According to one aspect of the present invention, the detachable swing is comprised of two end assemblies, a top rail coupled between the end assemblies, a swing hanger mounted on the top rail to hold a folding collapsible swing seat, two pairs of foot couplings, two bottom supports coupled between the foot couplings and arranged in parallel two pairs of legs bilaterally obliquely coupled between the end assemblies and the foot couplings, and two chinning bars connected between the legs at two opposite lateral sides, and two barrels mounted on the top rail between the swing hanger and the end assemblies to stop the swing hanger from sliding on the top rail. According to another aspect of the present invention, the end assemblies have a plurality of coupling holes disposed at different elevational for holding the top rail at one of a series of elevational positions. According to still another aspect of the present invention, the end assemblies, the top rail, the legs, the bottom supports and the foot couplings are detachable.

DETAILED DESCRIPTION OF THE PREFERRED EMBODIMENT

Figure 1:
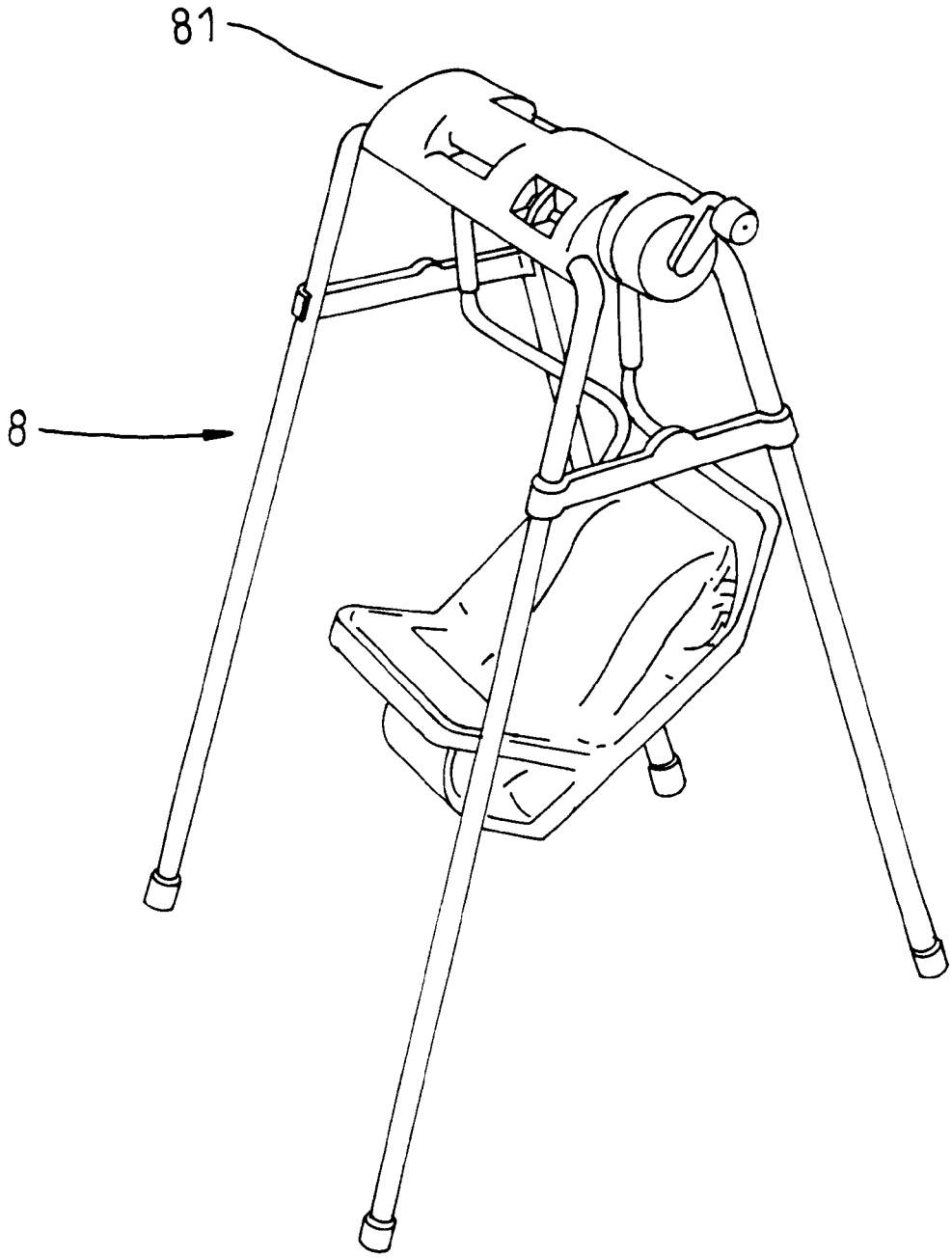
Fig. 1 PRIOR ART
FIG. 1 is an elevational view of a swing according to the prior art.
Figure 2:
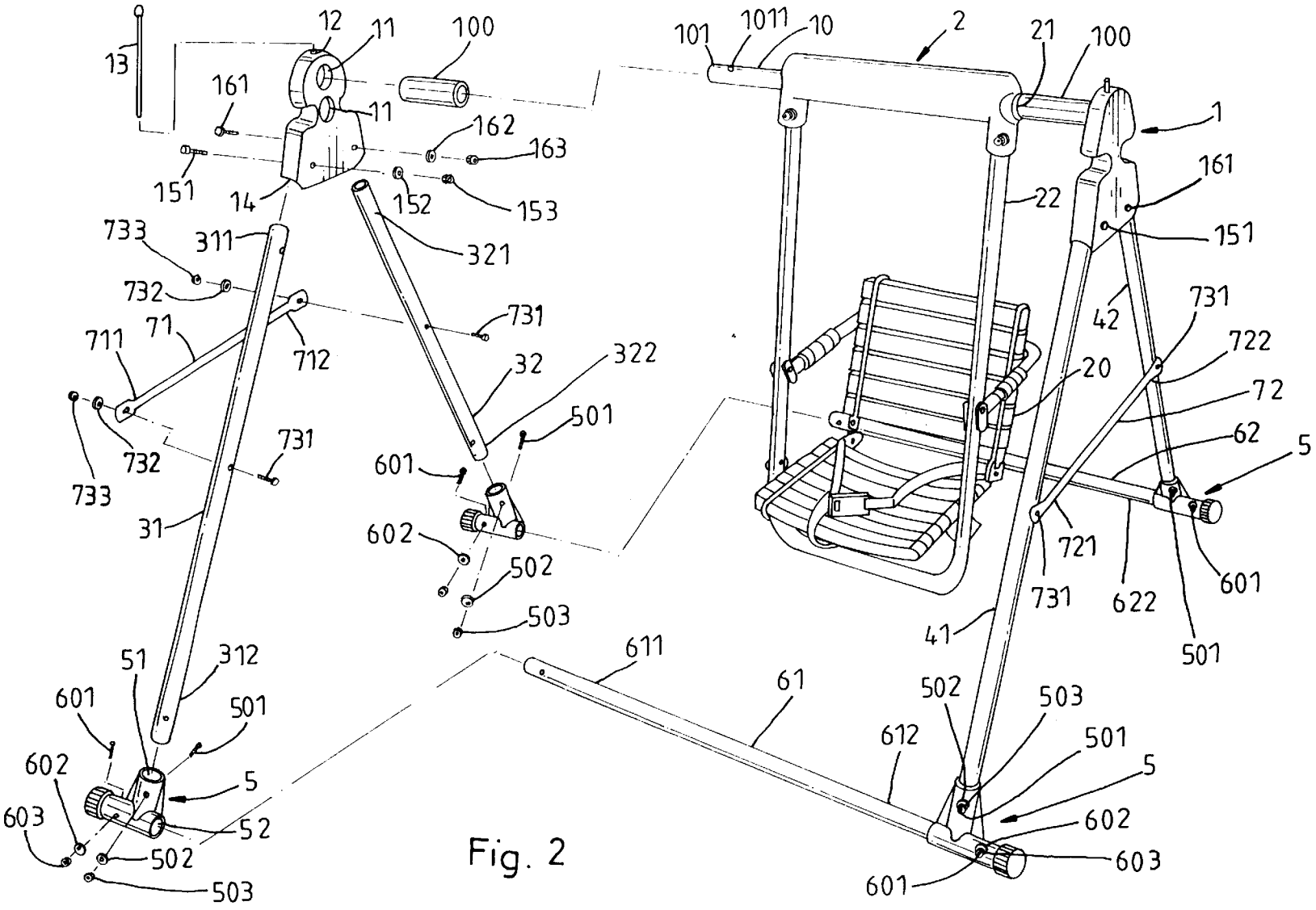
FIG. 2 is an exploded view of a detachable swing according to the Present invention.
Figure 3:
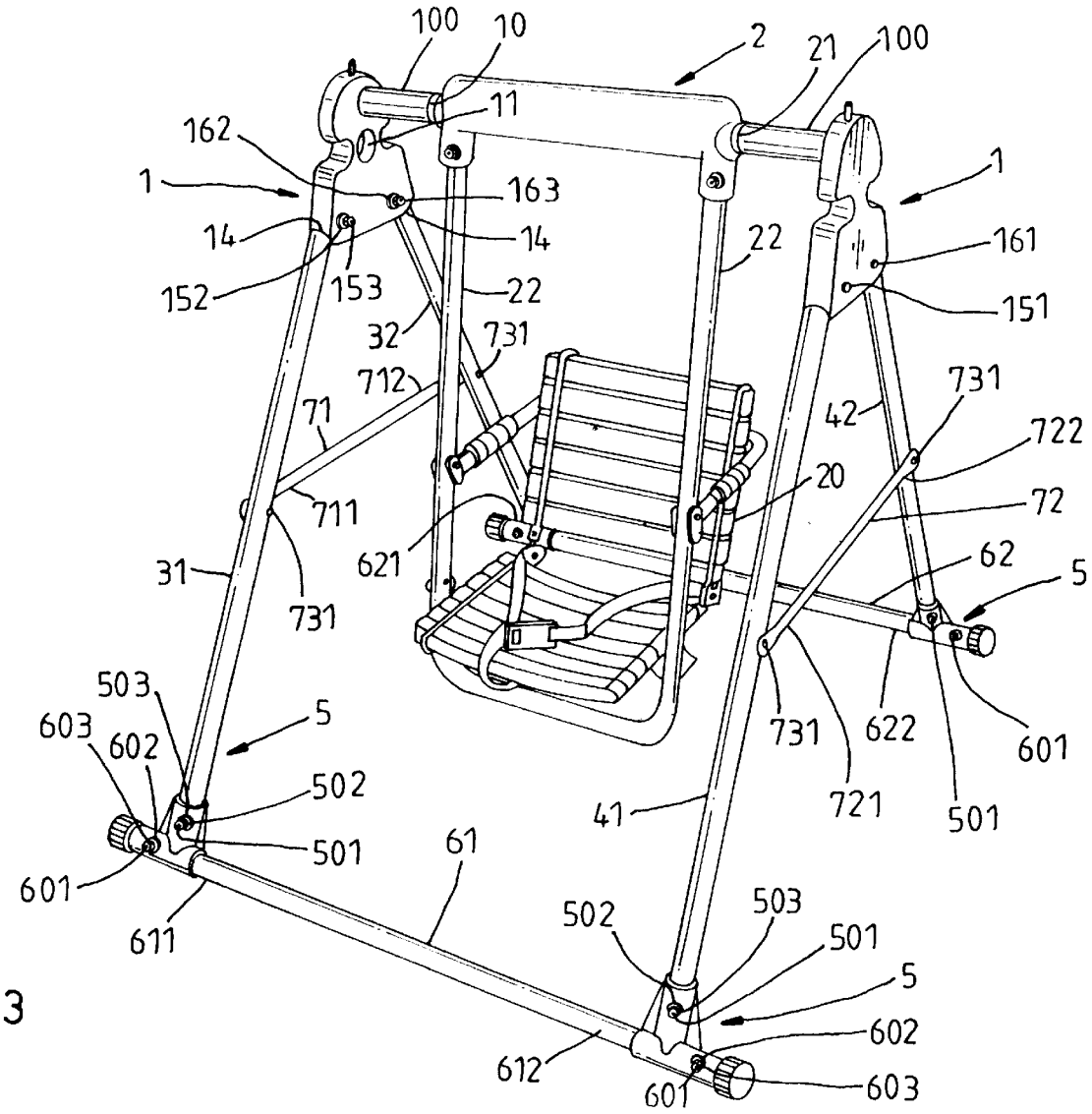
FIG. 3 is a perspective assembly view of the detachable swing shown in FIG. 2.
Figure 4:
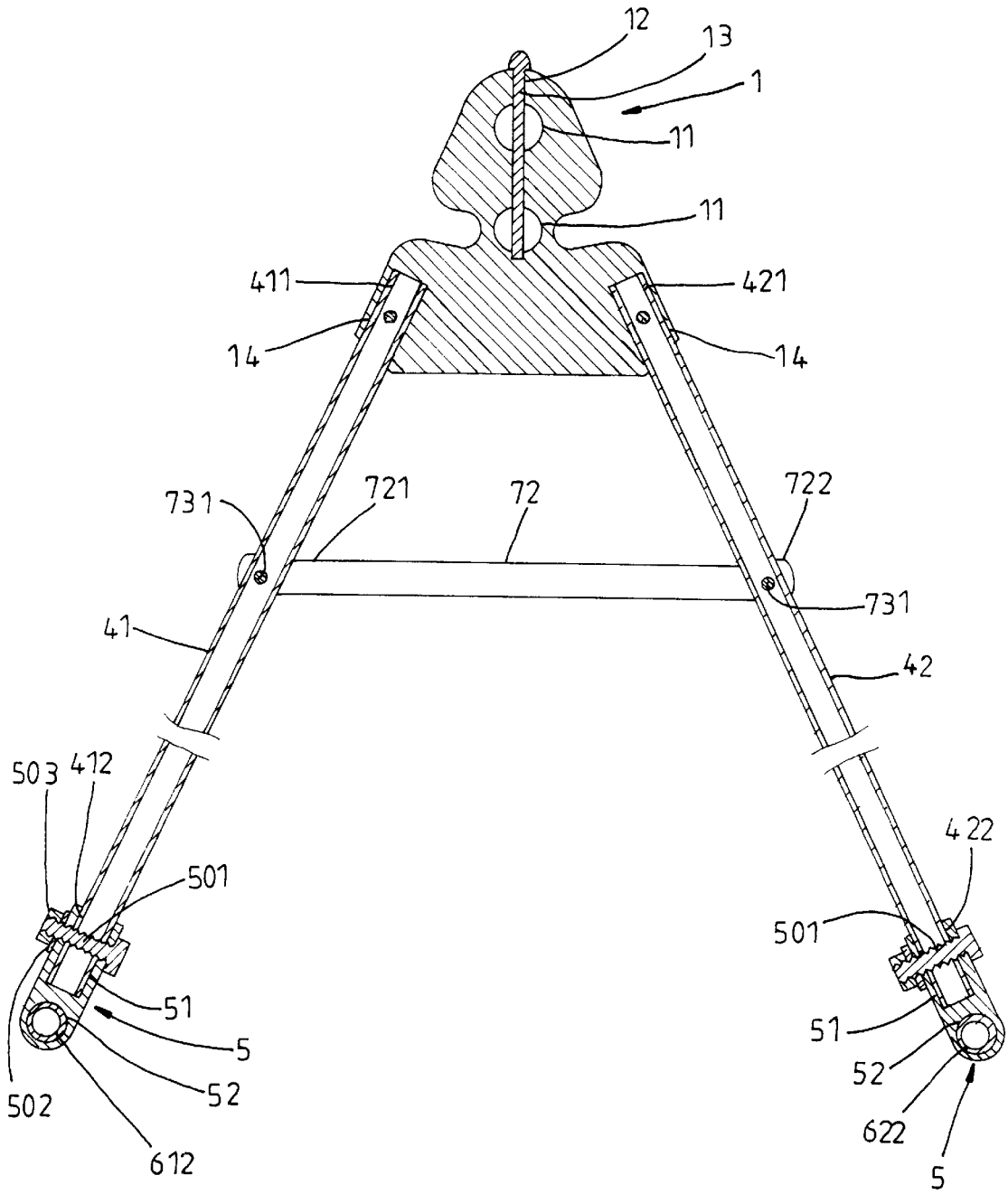
FIG. 4 is a side view in section in an enlarged scale of a part of the present invention.

Referring to FIGS. 2 through 4, a detachable swing in accordance with the present invention is generally comprised of two end assemblies 1, a top rail 10, two barrels 100, a swing hanger 2, a left front leg 31, a left rear leg 32, a ring front leg 41, a right rear leg 42, four foot couplings 5, a front bottom support 61, a rear bottom support 62, a left chinning bar 71, and a right chinning bar 72.

The end assemblies 1 each comprise a plurality of horizontal coupling holes 11 disposed at different elevations, a top pin hole 12 disposed in communication with the coupling holes 11, and two oblique bottom coupling holes 14. The top rail 10 has two pin holes 1011 respectively disposed near two distal ends 101 thereof. After insertion of the two distal ends 101 of the top rail 10 into one horizontal coupling hole 11 on each end assembly 1, two lock pins 13 are respectively mounted in the top pin hole 12 on each end assembly 1 and inserted into the pin holes 1011 on the top rail 10 to secure the end assemblies 1 to the two distal ends 101 of the top rail 10. The swing hanger 2 is mounted on the top rail 10 to hold a U-shaped swing bar 22 and a folding collapsible swing seat 20 at the U-shaped swing bar 22, having an axially extended through hole 21, which receives the top rail 10. The barrels 100 are respectively sleeved onto the top rail 10, and connected between the swing hanger 2 and the end assemblies 1 to stop the swing hanger 2 from axial movement along the top rail 10. The foot couplings 5 each comprise a top coupling hole 51, and a horizontal bottom coupling hole 52. The front bottom support 61 and the rear bottom support 62 are horizontally arranged in parallel, each having two distal ends 611 and 612, 621 and 622 respectively inserted into the horizontal bottom coupling hole 52 on each foot coupling 5 and secured thereto by fastening elements (screws, washers and nuts) 601, 602 and 603. The legs 31, 32, 41 and 42 are bilaterally coupled between the end assemblies 1 and the foot couplings 5, each having a top end 311, 321, 411 or 421 inserted into one bottom coupling hole 14 on one end assembly 1 and secured thereto by fastening elements 151, 152 and 153, or 161, 162 and 163, and a bottom end 312, 322, 412 or 422 inserted into the top coupling hole 51 on one foot coupling 5 and secured thereto by fastening elements 501, 502 and 503. The left chinning bar 71 is connected between the left front leg 31 and the left rear leg 32, having two distal ends 711 and 712 respectively fastened to a middle part of the left front leg 31 and a middle part of the left rear leg 32 by fastening elements 731, 732 and 733. The right chinning bar 72 is connected between the right front leg 41 and the right rear leg 42, having two distal ends 721 and 722 respectively fastened to a middle part of the right front leg 41 and the a middle part of the right rear leg 42 by fastening elements 731, 732 and 733.

What is claimed is:

1. A detachable swing comprising:

two end assemblies bilaterally disposed at a top side, said end assemblies each comprising a plurality of horizontal coupling holes disposed at different elevations, a top pin hole disposed in communication with the coupling holes in the corresponding end assembly, and two oblique bottom coupling holes;

a top rail horizontally connected between said end assemblies, said top rail having two distal ends respectively inserted into said horizontal coupling hole on each of said end assemblies, and two pin holes respectively disposed at the two distal ends thereof;

two lock pins respectively mounted in the top pin hole on each of said end assemblies and the pin holes on said top rail to secure said end assemblies to the two distal ends of said top rail;

a swing hanger mounted on said top rail and holding a folding collapsible swing seat, said swing hanger having an axially extended through hole, which receives said top rail;

two barrels respectively mounted on said top rail and connected between said swing hanger and said end assemblies to stop said swing hanger from axial movement along said top rail;

four foot couplings, said foot couplings each comprising a top coupling hole, and a horizontal bottom coupling hole;

a front bottom support and a rear bottom support respectively connected between said foot couplings and horizontally arranged in parallel, said front bottom support and rear bottom support each having two distal ends respectively inserted into the horizontal bottom coupling hole on said foot couplings and secured thereto by fastening elements;

four legs arranged in two pairs and respectively connected between said end assemblies and said foot couplings, said legs including a left front leg, a left rear leg, a right front leg and a right rear leg each having a top end fastened to one bottom coupling hole on one of said end assembly by fastening elements, and a bottom end fastened to the top coupling hole on one of said foot couplings by fastening elements; and a left chinning bar and a right chinning bar bilaterally connected between said legs, said left chinning bar having a front end fastened to a middle part of said left front leg by fastening elements and a rear end fastened to a middle part of said left rear leg by fastening elements, said right chinning bar having a front end fastened to a middle part of said right front leg by fastening elements and a rear end fastened to a middle part of said right rear leg by fastening elements.

* * * * *